US007267200B2

(12) United States Patent
Orrman

(10) Patent No.: US 7,267,200 B2
(45) Date of Patent: Sep. 11, 2007

(54) ELEVATOR WITH COMPACT ROPE SUSPENSION

(75) Inventor: Jaakko Orrman, Helsinki (FI)

(73) Assignee: Kone Corporation, Helsinki (FI)

( * ) Notice: Subject to any disclaimer, the term of this patent is extended or adjusted under 35 U.S.C. 154(b) by 362 days.

(21) Appl. No.: 10/602,719

(22) Filed: Jun. 25, 2003

(65) Prior Publication Data

US 2004/0035645 A1 Feb. 26, 2004

Related U.S. Application Data

(63) Continuation of application No. PCT/FI02/00054, filed on Jan. 23, 2002.

(30) Foreign Application Priority Data

Jan. 25, 2001 (FI) ..... 20010038 U

(51) Int. Cl.
*B66B 11/08* (2006.01)

(52) U.S. Cl. ..... 187/266; 187/411

(58) Field of Classification Search ..... 187/250, 187/254, 264, 266, 411
See application file for complete search history.

(56) References Cited

U.S. PATENT DOCUMENTS

| | | | | |
|---|---|---|---|---|
| 595,874 | A * | 12/1897 | Duwellius | 187/266 |
| 964,889 | A * | 7/1910 | Venn | 187/264 |
| 3,101,130 | A * | 8/1963 | Edoardo | 187/266 |
| 5,351,788 | A | 10/1994 | DeJong | |
| 5,878,847 | A * | 3/1999 | Mustalahti et al. | 187/266 |
| 5,906,251 | A * | 5/1999 | Aulanko et al. | 187/254 |
| 6,006,865 | A * | 12/1999 | Ammon | 187/266 |
| 6,035,974 | A * | 3/2000 | Richter et al. | 187/254 |
| 6,202,793 | B1 * | 3/2001 | Fargo | 187/256 |
| 6,247,557 | B1 * | 6/2001 | Kobayashi et al. | 187/266 |
| 6,302,239 | B1 * | 10/2001 | Honda | 187/254 |
| 6,471,012 | B2 * | 10/2002 | Faletto | 187/266 |
| 6,655,500 | B2 * | 12/2003 | Orrman et al. | 187/254 |
| 6,830,131 | B2 * | 12/2004 | Mustalahti et al. | 187/254 |
| 6,851,519 | B2 * | 2/2005 | Ach et al. | 187/266 |
| 2003/0089551 | A1 * | 5/2003 | Kato et al. | 182/1 |

FOREIGN PATENT DOCUMENTS

EP 0 866 018 A1 9/1998

(Continued)

OTHER PUBLICATIONS

"Elevator Mechanical Design: Principles and concepts" by Lubomir Janovsky, 1987, John Wiley & Sons, pp. 42-46.*

*Primary Examiner*—Donald Underwood
(74) *Attorney, Agent, or Firm*—Birch, Stewart, Kolasch, and Birch, LLP

(57) ABSTRACT

An elevator with an elevator car, guide rails, a counterweight and counterweight guide rails is arranged to minimize shaft space requirements. This elevator has a plurality of diverting pulleys mounted in an upper part of the shaft. A drive motor with a traction sheave is also mounted in the upper part of the shaft. There is at least one diverting pulley on both the elevator car and the counterweight. The car guide rails, the diverting pulleys in the upper part of the shaft and the drive motor and traction sheave are all on the same side of the elevator car. The elevator will take up as little space as possible in a transverse direction of the shaft and can be installed in a confined space.

14 Claims, 3 Drawing Sheets

FOREIGN PATENT DOCUMENTS

| | | | |
|---|---|---|---|
| FR | 2 640 604 | A1 | 6/1990 |
| JP | 1-160117 | A | 6/1989 |
| JP | 2000-153975 | A | 6/2000 |
| WO | WO99/43595 | A2 | 9/1999 |
| WO | WO 00/27739 | A1 | 5/2000 |
| WO | WO 02/26611 | A1 | 8/2000 |
| WO | WO 00/44664 | A1 | 4/2002 |
| WO | WO 02/059028 | A3 | 8/2002 |

* cited by examiner

ELEVATOR WITH COMPACT ROPE SUSPENSION

This application is a Continuation of copending PCT International Application No. PCT/FI02/00054 filed on Jan. 23, 2002, which was published in English and which designated the United States and on which priority is claimed under 35U.S.C. § 120, the entire contents of which are hereby incorporated by reference.

FIELD OF THE INVENTION

The present invention relates to an elevator with a rope suspension having a traction sheave and at least two diverting pulleys arranged to minimize the space used in the shaft.

DESCRIPTION OF THE RELATED ART

In prior art, Finnish patent application FI 990152 presents a traction sheave elevator with a diverting pulley mounted on a lateral side of the elevator car. Its car guide rails and counterweight guide rails are disposed in the elevator shaft on the same side of the elevator car. The elevator comprises a counterweight, an overhead rope pulley mounted on a fixed overhead structure in the upper part of the elevator shaft, a car rope pulley connected to the elevator car, a counterweight rope pulley connected to the counterweight, a drive motor arranged in the elevator shaft to drive one of the rope pulleys. Moreover, the elevator comprises a rope with a first end attached to the fixed overhead structure in the upper part of the elevator shaft on the same side of the elevator car as the car and counterweight guide rails, from where the rope is passed over the counterweight rope pulley, overhead rope pulley and car rope pulley, the second end of the rope being fastened to the fixed overhead structure. The structure according to the specification is implemented using a 2:1 suspension ratio.

When elevators are constructed in old buildings, it is necessary to consider the limitations associated with the spaces needed above and below the elevator in respect of the building space required, as well as the additional costs involved. If there is not enough space above the elevator, it may be impossible to place rope pulleys on top of the car.

BRIEF SUMMARY OF THE INVENTION

The object of the invention is to disclose a new type of rope elevator suspension solution for a rucksack-type structure that takes up as little space as possible in the transverse direction of the shaft so as to allow a maximally effective utilization of the elevator shaft space. A further object of the invention is to disclose a rope elevator suspension solution for elevators to be installed in a confined space and elevators to be operated at a low speed, such as e.g. those designed for disabled persons.

The invention is characterized by what is presented in the characterization part of claim 1. Other embodiments of the invention are characterized by what is presented in the other claims.

The invention provides the advantage of allowing the elevator to be constructed in as compact a form as possible in respect of utilization of the cross-sectional area of the shaft. By employing the suspension solution of the invention in the elevator, it will be possible to hoist a big load with a smaller machine. The structure of the invention allows a slim machine and counterweight construction in the depthwise direction of the shaft, thus allowing effective utilization of shaft space in the widthwise direction. By mounting the machine in a position parallel to a shaft wall, no unused space is formed in the shaft due to an oblique position of the machine. By using the preferable suspension ratio of 4:1, a low car speed is produced with a reasonable number of revolutions of the machine and using a small machine, the rope speed thus equaling four times the speed of the elevator car. The rope suspension alternative of the invention is easy to install in different ways, the suspension lay-out is clear.

A low car speed is also produced by using a 3:1 rope suspension ratio, in which case the car speed is equal to one third of the rope speed on the motor circumference. By using a 3:1 suspension ratio, the space required by the elevator in the transverse direction of the shaft can be reduced because the rope pulleys for the suspension of the car and counterweight are placed side by side in the same plane at a side wall of the shaft. The most essential advantage of the actual rope suspension is achieved when it is technically advantageous to use a relatively high rotational speed of the machine relative to the nominal speed. In other words, the advantage is greatest if a low nominal car speed is needed, as in elevators for disabled persons and in freight elevators. It is advantageous to reduce the speed via the rope arrangement of the elevator.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described in detail with reference to the attached drawings, which are given by way of illustration only, and thus are not limitative of the present invention, and wherein.

DETAILED DESCRIPTION OF THE INVENTION

Figure 1:
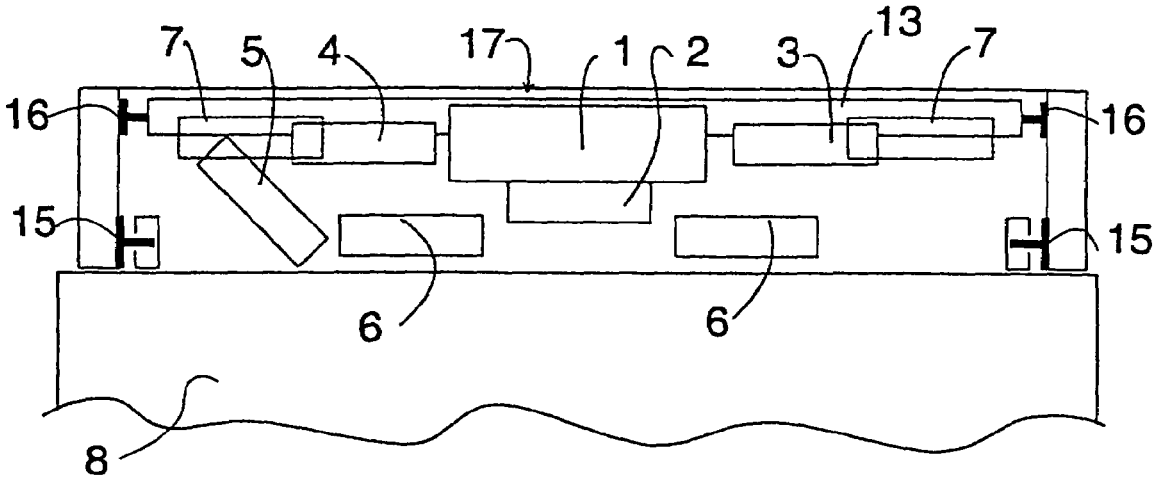
FIG. 1 presents an embodiment of the invention for the suspension of an elevator as seen from above.
Figure 3:
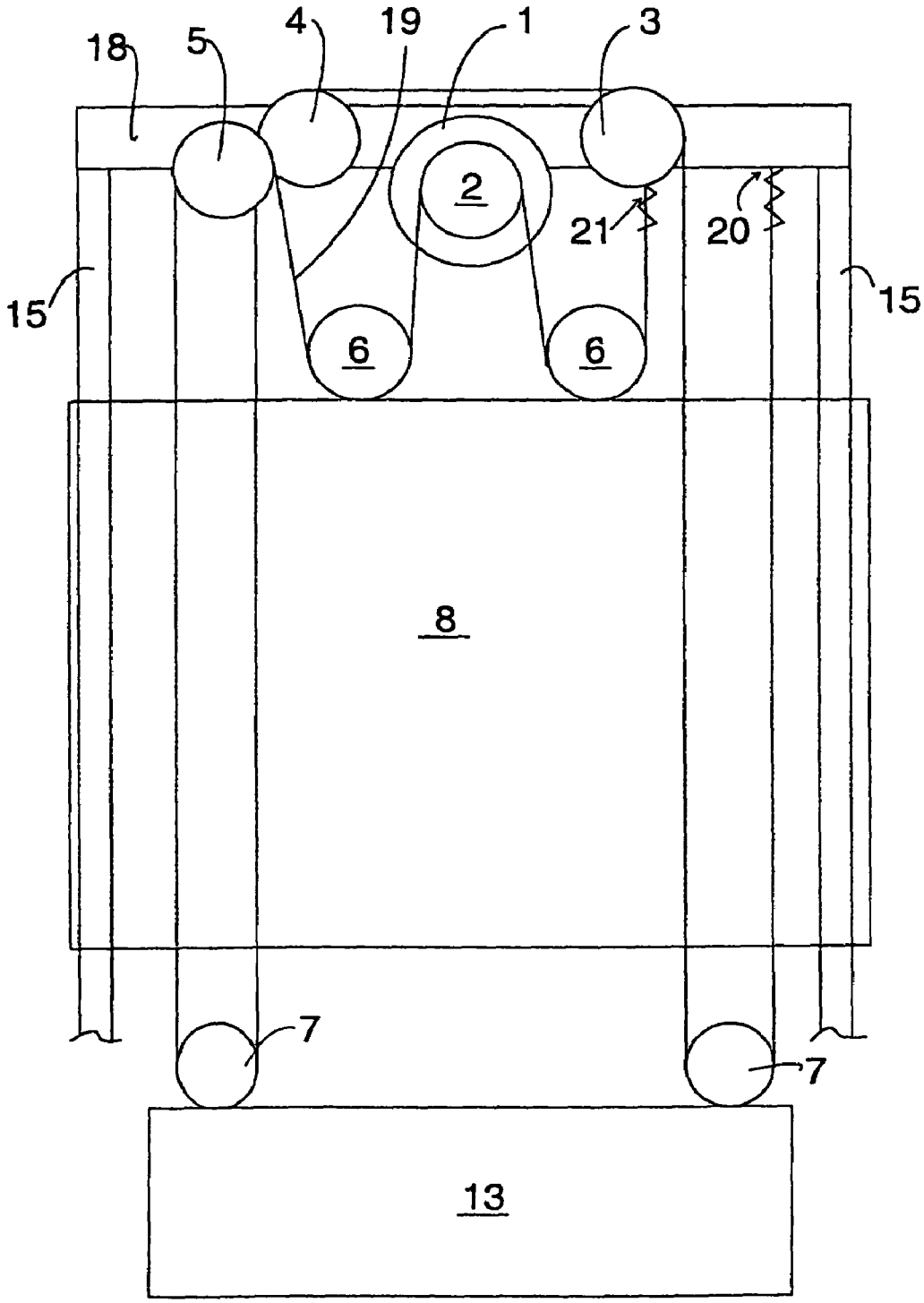
FIG. 3 presents the solution of FIG. 1 in front view.

FIG. 1 shows a top view of a traction sheave elevator in which the suspension of the elevator car is implemented on the so-called rucksack principle. The car guide rails 15 are arranged vertically in the shaft and the car 8 is designed to be movable along the guide rails. The counterweight guide rails 16 for guiding the counterweight 13 are placed vertically in the shaft. The counterweight guide rails are placed on the same side of the elevator car 8 as the car guide rails 15. The counterweight guide rails and the car guide rails are mounted side by side parallel to each other on the side of the car facing towards the wall 17. The counterweight guide rails are placed on the side of the wall. The drive motor 1 is supported by a transverse overhead structure 18 (FIG. 3) of the shaft. The traction sheave 2 of the motor 1 is connected to the motor. The fixed diverting pulleys 3 and 4 of the elevator are mounted on the fixed overhead structure 18 (FIG. 3). The diverting pulleys 6 of the car are attached to a load-bearing structure of the car 8 on the same side as the car guide rails. The diverting pulleys 7 of the counterweight are attached to a load-bearing structure of the counterweight 13. An overhead diverting pulley 5 is mounted on the fixed overhead structure 18 of the shaft and its plane of rotation is at a certain angle relative to the wall 17. The fixed overhead structure of the elevator bears the forces in the shaft.

Figure 2:
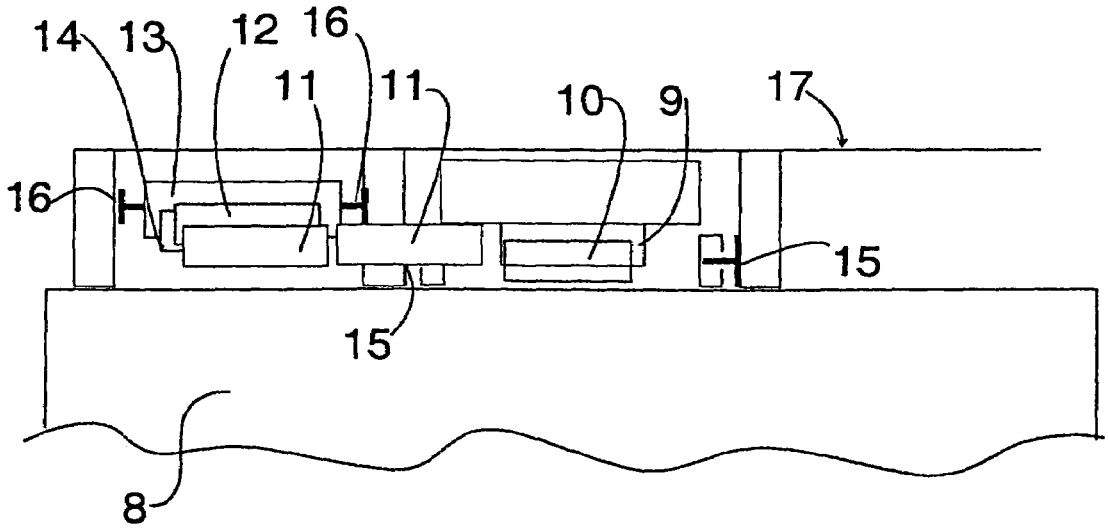
FIG. 2 presents another embodiment of the invention for the suspension of an elevator as seen from above.

FIG. 2 presents another embodiment of the invention. The figure shows a diagrammatic top view of a traction sheave elevator. The car guide rails 15 are arranged vertically in the shaft and the car 8 is arranged to be movable along them. The counterweight guide rails 16 for guiding the counterweight 13 are located in the shaft on the same side of the elevator car 8 as the car guide rails 15, but they are placed on one side of the machine, so the width of the counterweight does not occupy the whole shaft width. The drive motor 1 is mounted on an overhead structure of the shaft. The traction sheave 9 of the motor 1 is connected to the motor. The planes of rotation of a fixed diverting pulley 10 of the car, two fixed diverting pulleys 11, a diverting pulley 12 mounted on the fixed overhead structure and a diverting pulley 14 of the counterweight 13 are all in the same plane and are oriented in the shaft in a direction parallel to the wall 17.

FIG. 3 shows a front view of the solution presented in FIG. 1. The rope 19 is passed over the diverting pulleys as follows. The first end 20 of the rope is attached to the fixed overhead structure 18, from where it passes under one of the counterweight diverting pulleys 7, then via the fixed diverting pulleys 3 and 4 on the fixed overhead structure, passing over the drive motor 1, to the other counterweight diverting pulley 7, from where the rope 19 is further passed via the overhead diverting pulley 5 to one of the diverting pulleys 6 of the car and then via the traction sheave 2 of the motor to the other diverting pulley 6 of the car, from which the second end 21 of the rope goes to the fixed overhead structure 18, to which it is fastened. The rope 19 may also comprise a plurality of ropes.

Figure 4:
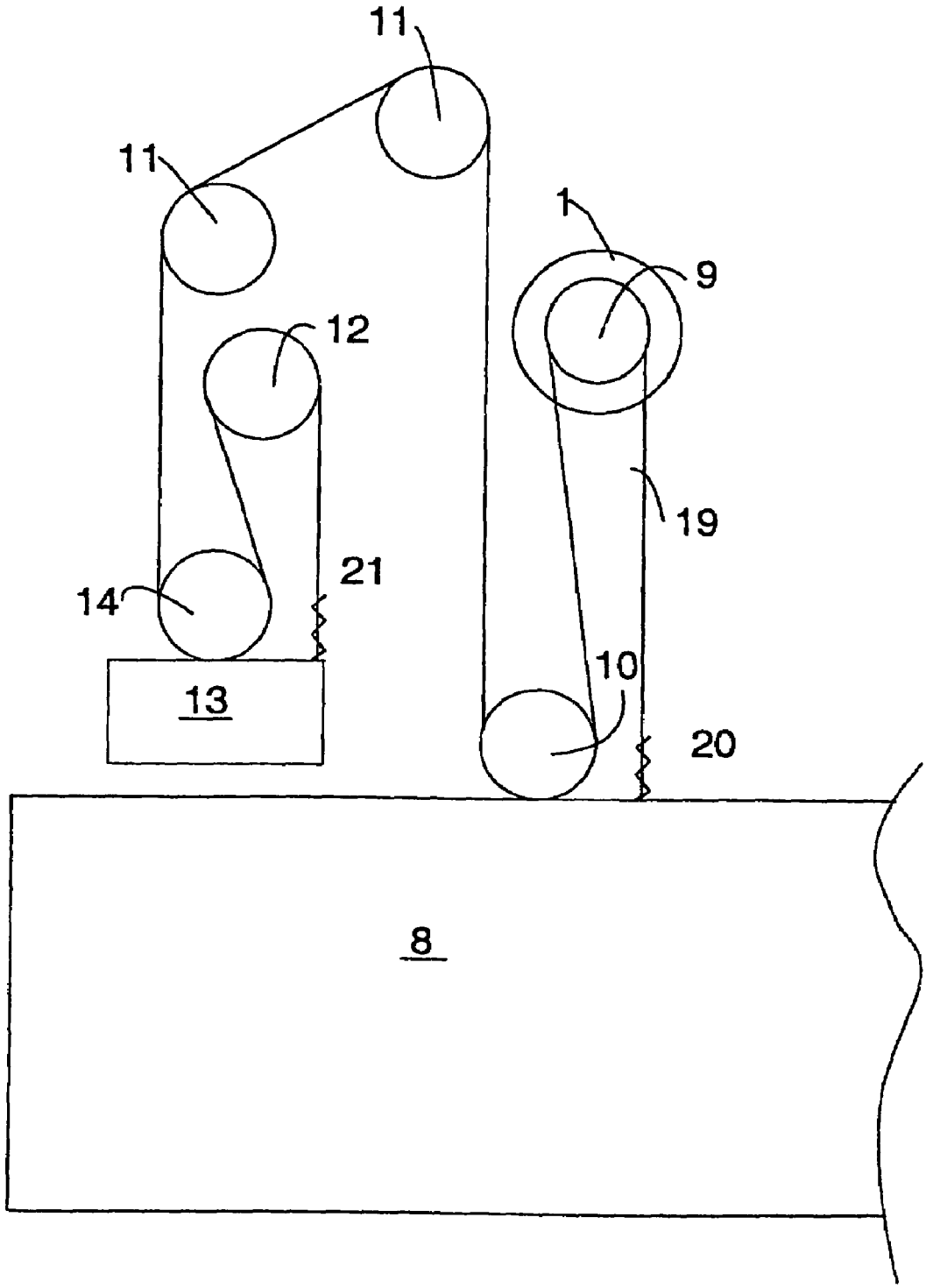
FIG. 4 presents the solution of FIG. 2 in front view.

FIG. 4 shows a front view of the solution presented in FIG. 2. The rope 19 has been arranged to run over the diverting pulleys as follows. The first end 20 of the rope is fixed to the load-bearing structure of the car 8, from which it is passed over the diverting pulley 9 of the motor 1 to and under a diverting pulley 10 fixed to the car 8 and further via fixed diverting pulleys 11 mounted on the shaft structure to and under a diverting pulley 14 fixed to the load-bearing structure of the counterweight 13, from where the rope goes further over an overhead diverting pulley 12 and is fastened to the load-bearing structure of the counterweight 13.

The invention is not limited to the examples of its embodiments described above; instead, many variations are possible within the inventive idea defined in the claims.

The invention claimed is:

1. An elevator comprising:

an elevator car;

car guide rails disposed in a vertical direction of an elevator shaft;

counterweight guide rails in the elevator shaft;

a counterweight guided by the counterweight guide rails, a plurality of diverting pulleys mounted in an upper part of the shaft; and a drive motor with a traction sheave, the drive motor and traction sheave being in the upper part of the shaft;

a rope system;

at least one diverting pulley on the elevator car; and at least one diverting pulley on the counterweight, the car guide rails, the plurality of diverting pulleys in the upper part of the shaft and the drive motor and traction sheave being on a same side of the elevator car, both the car and the counterweight have a suspension ratio of 3:1 or greater and the traction sheave having a plane of rotation parallel to at least one of the diverting pulley on the elevator car and the diverting pulley on the counterweight.

2. The elevator as defined in claim 1, wherein the plurality of diverting pulleys mounted in the upper part of the shaft include three diverting pulleys mounted in the upper part of to elevator shaft, the at least one diverting pulley of the counterweight comprising two diverting pulleys for supporting the counterweight, the at least one diverting pulley on the elevator car comprising two diverting pulleys for supporting the elevator car, both the elevator car and the counterweight having a suspension ration of 4:1.

3. The elevator as defined in claim 2, wherein the plurality of diverting pulleys include a diverting pulley with a plane of rotation at an angle relative to a wall of the elevator shaft, the elevator further comprising a fixed overhead structure in the elevator shaft on which the plurality of diverting pulleys are mounted.

4. The elevator as defined in claim 3, wherein the plurality of diverting pulleys further include a diverting pulley with a plane of rotation parallel to a wall of the elevator shaft.

5. The elevator as defined in claim 2, wherein the plurality of diverting pulleys include a diverting pulley with a plane of rotation parallel to a wall of the elevator shaft.

6. The elevator as defined in claim 5, wherein all of the plurality of diverting pulleys have a plane of rotation parallel to the wall of the elevator shaft.

7. The elevator as defined in claim 1, wherein the plurality of diverting pulleys mounted in the upper part of the shaft include three diverting pulleys mounted in the upper part of the elevator shaft, the at least one diverting pulley of the counterweight comprising one diverting pulley for supporting the counterweight, the at least one diverting pulley on the elevator car comprising one diverting pulley for supporting the elevator car, both the elevator car and the counterweight having a suspension ration of 3:1.

8. The elevator as defined in claim 7, wherein all of the diverting pulleys are in the same plane.

9. The elevator as defined in claim 1, wherein all of the diverting pulleys are in the same plane.

10. The elevator as defined in claim 1, wherein the drive motor and the guide rails are disposed in the elevator shaft on a lateral side of the car on a same side of the car.

11. The elevator as defined in claim 1, wherein the counterweight guide rails and the car guide rails are disposed in the elevator shaft on a same side of the elevator car.

12. The elevator as defined in claim 1, wherein the traction sheave and the plurality of diverting pulleys mounted in the upper part of the shaft are in the same plane.

13. The elevator as defined in claim 1, wherein the car guide rails are mounted between the counterweight guide rails and the elevator car.

14. The elevator as defined in claim 1, wherein the car guide rails and the counterweight guide rails are mounted on a same side of the elevator but are laterally offset from one another.

* * * * *